US012135161B2

(12) United States Patent
Nooli et al.

(10) Patent No.: US 12,135,161 B2
(45) Date of Patent: Nov. 5, 2024

(54) DEFROSTING SYSTEM FOR A COLD PLATE AND METHOD OF DEFROSTING A COLD PLATE

(71) Applicant: PepsiCo, Inc., Purchase, NY (US)

(72) Inventors: Praveen Kumar Nooli, Coram, NY (US); John Michael Hartney, Cross River, NY (US); Gurmeet Singh Bhutani, Gurgaon (IN); Andrew Hoffman, Prosper, TX (US); Joseph E. Stapleton, Cheshire, CT (US); Atul Tripathi, Chappaqua, NY (US)

(73) Assignee: PepsiCo, Inc., Purchase, NY (US)

( * ) Notice: Subject to any disclaimer, the term of this patent is extended or adjusted under 35 U.S.C. 154(b) by 382 days.

(21) Appl. No.: 16/417,382

(22) Filed: May 20, 2019

(65) Prior Publication Data

US 2020/0370816 A1 Nov. 26, 2020

(51) Int. Cl.

| | |
|---|---|
| ***F25D 21/00*** | (2006.01) |
| ***F25D 21/02*** | (2006.01) |
| ***F25D 21/08*** | (2006.01) |

(52) U.S. Cl.

CPC ..... *F25D 21/008* (2013.01); *F25D 21/02* (2013.01); *F25D 21/08* (2013.01); *F25D 2600/02* (2013.01); *F25D 2700/122* (2013.01)

(58) Field of Classification Search

CPC ..... F25D 21/08; F25D 21/008; F25D 21/02; F25D 2700/122; F25D 2600/02

See application file for complete search history.

(56) References Cited

U.S. PATENT DOCUMENTS

| | | | | |
|---|---|---|---|---|
| 3,756,037 | A | 9/1973 | Raufeisen et al. | |
| 3,875,758 | A | 4/1975 | Fischer | |
| 5,966,951 | A * | 10/1999 | Hallin | F25D 17/062 62/154 |
| 2008/0104973 | A1* | 5/2008 | Hall | F25D 21/08 62/140 |
| 2009/0139261 | A1 | 6/2009 | Nakano et al. | |

(Continued)

FOREIGN PATENT DOCUMENTS

| | | | |
|---|---|---|---|
| CN | 102706073 | A | 10/2012 |
| CN | 205585718 | U | 9/2016 |

(Continued)

OTHER PUBLICATIONS

International Search Report and Written Opinion of the International Searching Authority in International Application No. PCT/US2020/033583, mailed Jul. 30, 2020 (9 pages).

*Primary Examiner* — Joel M Attey
*Assistant Examiner* — Meraj A Shaikh
(74) *Attorney, Agent, or Firm* — Sterne, Kessler, Goldstein & Fox P.L.L.C.

(57) ABSTRACT

A cooler including a cabinet defining an interior volume for storing a perishable product. A cold plate is disposed within the cabinet, and the cold plate is configured to absorb heat within the cabinet. The cooler further includes a defrosting system that includes a sensor configured to detect a presence of frost on a surface of the cold plate, a heating element affixed to the surface of the cold plate that is configured to at least partially melt frost on the cold plate, and a control unit configured to selectively activate and deactivate the heating element when the presence of frost is determined by the sensor.

19 Claims, 8 Drawing Sheets

(56) References Cited

U.S. PATENT DOCUMENTS

| | | | | |
|---|---|---|---|---|
| 2009/0173093 | A1* | 7/2009 | Sueda | F25D 23/025 62/157 |
| 2009/0249795 | A1* | 10/2009 | Chen | F25D 21/06 62/155 |
| 2010/0180614 | A1* | 7/2010 | Larson | B60H 1/3232 165/104.11 |
| 2012/0055180 | A1* | 3/2012 | Larson | F25D 16/00 62/272 |
| 2012/0198863 | A1* | 8/2012 | Hall | F25D 21/08 62/126 |
| 2016/0123649 | A1 | 5/2016 | Ahn et al. | |
| 2016/0161167 | A1 | 6/2016 | Junge et al. | |
| 2017/0176084 | A1* | 6/2017 | Iwamoto | F25B 49/02 |
| 2017/0292770 | A1* | 10/2017 | Fowler | A47F 3/0447 |
| 2017/0314840 | A1* | 11/2017 | Eschner | F25D 17/062 |
| 2019/0234676 | A1* | 8/2019 | Walser | F25D 21/006 |
| 2019/0285332 | A1* | 9/2019 | Kim | F25D 17/062 |
| 2020/0173708 | A1* | 6/2020 | Kim | F25D 11/02 |

FOREIGN PATENT DOCUMENTS

| | | | |
|---|---|---|---|
| CN | 208291920 | U | 12/2018 |
| DE | 202012101093 | U1 | 8/2012 |
| JP | S53-090253 | U | 7/1978 |
| JP | S57-174670 | A | 10/1982 |
| JP | H06-034258 | A | 2/1994 |
| JP | H07-091813 | A | 4/1995 |
| JP | H09210536 | A | 8/1997 |
| JP | 2017-227377 | A | 12/2017 |
| KR | 101951207 | B1 | 2/2019 |
| WO | 2000049349 | A1 | 8/2000 |

* cited by examiner

DEFROSTING SYSTEM FOR A COLD PLATE AND METHOD OF DEFROSTING A COLD PLATE

FIELD

Embodiments described herein generally relate to systems for defrosting a cold plate. Specifically, embodiments described herein relate to systems for defrosting a cold plate containing a phase-change material by means of a heating element applied to a surface of the cold plate.

BACKGROUND

Perishable products, such as food, beverages, cosmetics, and medicine, among various other products, are often stored and transported in a refrigerated or temperature-controlled compartment, such as a refrigerator, cooler, or shipping container, among others. The perishable products must be maintained at a specific temperature or range of temperatures in order to prevent spoilage of the perishable products and to ensure that the products meet quality control requirements.

In order to maintain the temperature of a cooler at the desired storage temperature during shipping or transportation, phase-change material (PCM) cold plates are commonly used to absorb heat as an alternative to mechanical refrigeration systems. For example, PCM cold plates may be positioned in a refrigerated or temperature-regulated compartment for absorbing heat that may enter the compartment, such as when a door of the compartment is opened. A PCM cold plate may be cooled or "charged" prior to use such that the PCM is frozen and is solid. During operation, the PCM is able to absorb heat while maintaining a constant temperature. In this way, the PCM cold plate helps to maintain the interior volume of the refrigerator or cooler at the desired storage temperature.

BRIEF SUMMARY OF THE INVENTION

Some embodiments relate to a cooler that includes a cabinet defining an interior volume for storing a perishable product, a cold plate disposed within the cabinet, wherein the cold plate is configured to absorb heat within the cabinet, a defrosting system that includes a sensor configured to detect a presence of frost on a surface of the cold plate, a heating element affixed to the surface of the cold plate configured to at least partially melt frost on the cold plate, and a control unit configured to selectively activate and deactivate the heating element when the presence of frost is detected by the sensor.

In any of the various embodiments discussed herein, the heating element may include a foil heating element. In some embodiments, the heating element may be affixed to the surface of the cold plate by means of an adhesive. In some embodiments, the heating element may be one of a plurality of heating elements arranged on the surface of the cold plate.

In any of the various embodiments discussed herein, the cold plate may include a phase-change material. In some embodiments, the phase-change material may include a eutectic solution.

In any of the various embodiments discussed herein, the control unit may be configured to activate the heating element for a predetermined amount of time. In some embodiments, the control unit may be configured to activate the heating element for the predetermined amount of time at a predetermined interval.

In any of the various embodiments discussed herein, the sensor may be a temperature sensor configured to detect a temperature of a surface of the cold plate. In some embodiments, the temperature sensor may be a thermistor or thermocouple.

Some embodiments relate to a method for defrosting a cold plate of a cooler that includes determining a presence of frost on a surface of the cold plate within the cooler by a sensor, and activating a heating element that is disposed on the surface of the cold plate when the presence of frost is detected by the sensor, such that the heating element at least partially melts the frost.

In any of the various embodiments discussed herein, activating the heating element may include activating a foil heating element.

In any of the various embodiments discussed herein, the method for defrosting the cold plate may include deactivating the heating element when a temperature of the surface of the cold plate reaches a predetermined temperature maximum as determined by a secondary sensor.

In any of the various embodiments discussed herein, the cooler may include a fan configured to circulate air over the cold plate, and the method may further include deactivating the fan prior to activating the heating element. In some embodiments, the method may further include reactivating the fan after deactivating the heating element. In some embodiments, the method may further include reactivating the fan after a predetermined dwell time has elapsed after deactivating the heating element.

In any of the various embodiments discussed herein, the sensor may be a temperature sensor, and the heating element may be activated when a temperature of a fluid at an outlet of the cold plate as determined by the temperature sensor is at or below a predetermined temperature minimum.

In any of the various embodiments discussed herein, the sensor may be a frost sensor configured to determine an amount of frost on the cold plate, and the heating element may be activated when the amount of frost on the cold plate as determined by the frost sensor is at or above a predetermined amount.

Some embodiments relate to a method for defrosting a cold plate that includes determining a presence of frost on a surface of the cold plate by means of a sensor, activating a heating element disposed on the surface of the cold plate for a predetermined amount of time in order to at least partially melt the frost when the presence of frost is detected by the sensor, and deactivating the heating element once the predetermined amount of time has elapsed.

In any of the various embodiments discussed herein, the method may include activating the heating element for the predetermined amount of time at a predetermined interval.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION OF THE INVENTION

Figure 1:
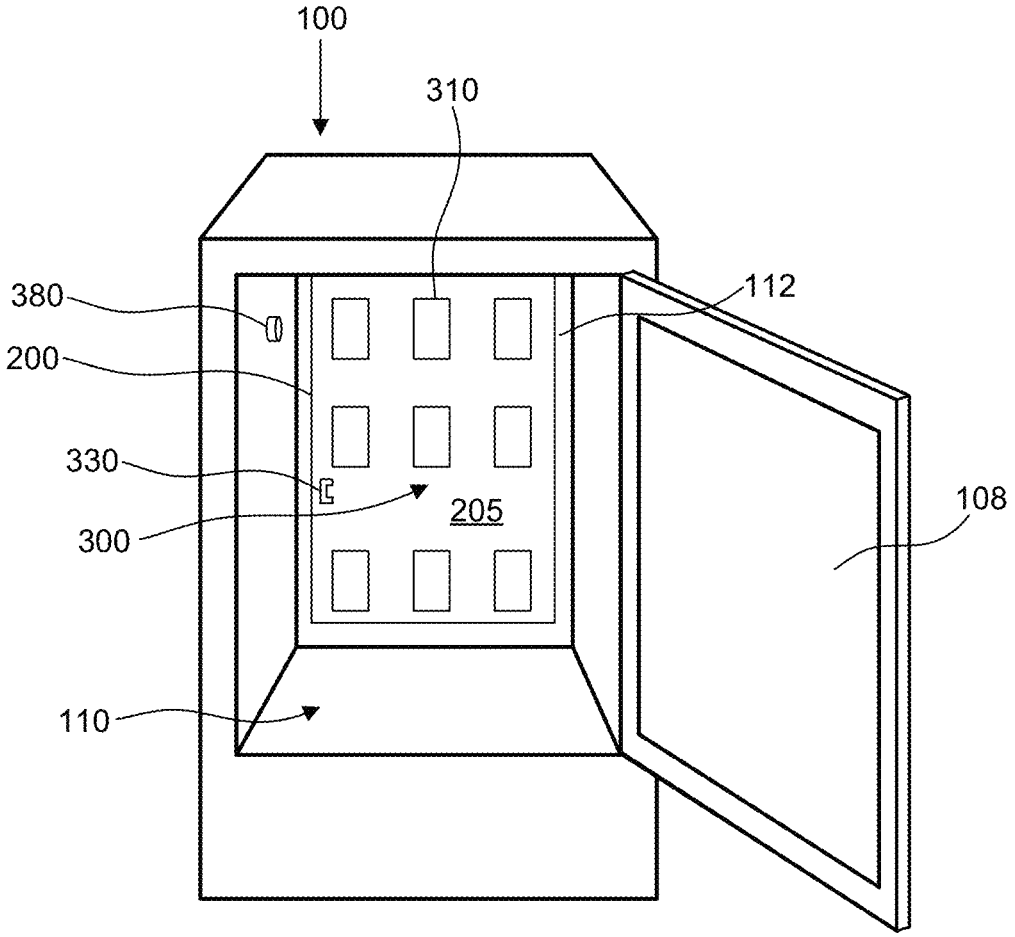
FIG. 1 shows a perspective view of a cooler having a cold plate with a defrosting system according to an embodiment.

Reference will now be made in detail to representative embodiments illustrated in the accompanying drawing. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

Phase-change material (PCM) cold plates can be used to absorb heat to help to maintain a refrigerated or temperature-regulated compartment, such as a cooler, refrigerator, shipping container, or the like at a desired temperature. PCM cold plates may be used in a refrigerated compartment having a dedicated cooling unit, or may be used to provide cooling in a compartment lacking a dedicated cooling unit. While PCM cold plates may help to maintain the desired storage temperature within the compartment, PCM cold plates are susceptible to accumulation of frost and ice. Humidity or moisture in the air entering the compartment, whether by opening a door that provides access to the compartment, or by air bleed into the compartment, may condense on a surface of the cold plate causing frost or ice to form on the cold plate. As the frost accumulates, the ability of the cold plate to absorb heat from the compartment is inhibited. Accordingly, it is necessary to periodically clear the frost or ice from the cold plate to ensure the cold plate performs optimally and maintains the compartment at the desired temperature.

Clearing frost and ice from the cold plate can be time consuming and inconvenient. When the cold plate is used in a cooler, the cooler is generally taken off-line and the cold plate is cleared manually, such as by scraping the frost or ice from the surface of the cold plate. As the frost or ice is scraped from the cold plate with the cooler off-line, the interior volume of the cooler may increase in temperature such that products cannot be stored therein. As a result, it may be necessary to remove the products from the cooler and move the products to another refrigerated area while frost is removed from the cold plate. Once the cold plate is clear of frost, additional downtime may be required while the cooling unit of the cooler returns the cooler to the desired storage temperature, and the products must then be manually moved back into the cooler.

While a refrigeration or cooling unit of a cooler may have a dedicated defrosting unit, such defrosting units are undesirable when a cold plate is used. The cold plate is configured to absorb heat, and as a result the cold plate may counteract the heating of the cooler by the defrosting unit of the cooler, causing the defrosting process to take a longer period of time. Further, defrosting the cooler causes the entire interior volume of the cooler to rise, which is undesirable when the cooler is used for storing perishable products. Increasing the temperature may result in spoilage of the perishable products, and may be inconsistent with food safety storage requirement and/or quality control practices. Thus, it would be desirable to defrost the cold plate without taking the cold plate or cooler off-line and without significantly raising the temperature of the interior volume of the cooler.

Some embodiments described herein relate to a defrosting system for a cold plate that is configured to at least partially melt frost or ice on a surface of the cold plate. In this way, the defrosting system helps to remove frost from the cold plate to ensure that the cold plate functions optimally. In some embodiments, a defrosting system for a cold plate is configured to at least partially melt frost or ice on a surface of the cold plate without significantly increasing the temperature of the interior volume of the cooler in which the cold plate is positioned, such that perishable products stored within interior volume remain at the desired storage temperature.

In some embodiments described herein, a cold plate 200 is positioned within a cooler 100 for absorbing heat within an interior volume 110 of cooler 100, such as along an interior wall 112 of cooler 100. A defrosting system 300 may be coupled with cold plate 200 for removing frost or ice from a surface 205 of cold plate 200 (i.e., defrosting). Defrosting system 300 may include a sensor 330 (see FIG. 3) for detecting a presence of frost on surface 205 of cold plate 200, a heating element 310 positioned on surface 205 of cold plate 200 for melting the frost on cold plate 200, and a control unit 350 configured to automatically activate heating element 310 when frost is detected by sensor 330.

As described herein, the term "cooler," may refer to any container, vessel, or compartment having an interior volume for storing a product. A "cooler" may refer to a refrigerated compartment, such as a refrigerated display case or a refrigerator for storing perishable food or beverage products, a temperature-regulated or insulated compartment, or a shipping container for transporting perishable products, such as food or beverages, while maintaining the perishable products at a specific temperature or range of temperatures in order to prevent spoilage, deterioration, or degradation of the products. Thus, cooler may have a dedicated cooling unit or refrigeration unit, or cooler may lack a dedicated cooling unit.

In some embodiments described herein, cooler 100 defines an interior volume 110 for storing perishable products, such as food or beverages, as shown for example at FIG. 1. Cooler 100 may be in the form of a cabinet. Cooler 100 is shown as a rectangular prism, however, cooler 100 may have any of various shapes and configurations, and, for example, cooler may include one or more curved or rounded walls. Cooler 100 may further include a transparent portion 108 composed of a transparent material, such as glass, so that interior volume 110 of cooler 100 is visible from an exterior of cooler 100. In some embodiments, cooler 100 may include one or more shelves for storing and organizing perishable products within interior volume 110.

A cold plate 200 may be positioned within cooler 100 for absorbing heat within cooler 100. In some embodiments, cold plate 200 may be positioned within interior volume 110 of cooler 100 on or along a wall of cooler 100, such as on a rear wall 112 of cooler 100. In some embodiments, cooler 100 may include two or more cold plates 200, wherein cold plates 200 may be positioned on the same wall or on different walls of cooler 100. Two or more cold plates 200 may be used depending upon the size of cooler 100 and the size of cold plate 200. While it is understood that more than one cold plate 200 may be used, a single cold plate 200 will be referred to herein for simplicity.

Figure 2:
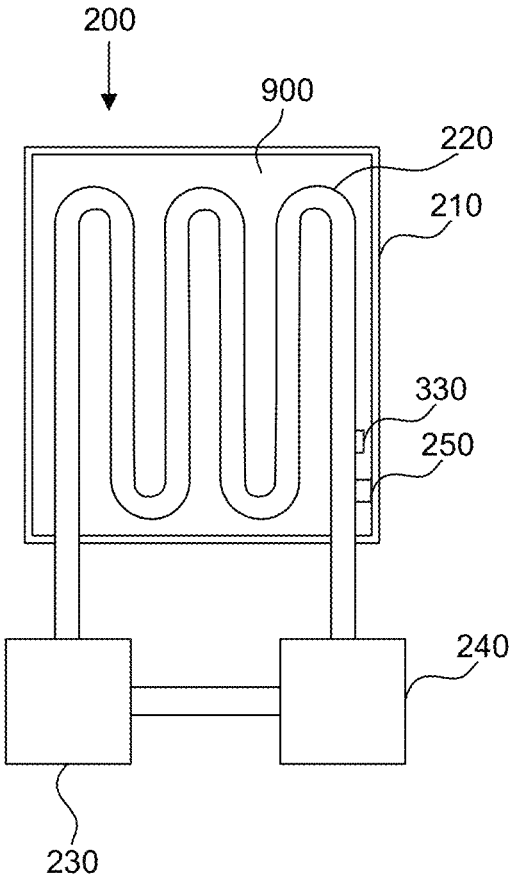
FIG. 2 shows a diagram of components of a cold plate according to an embodiment.

Cold plate 200 may include one or more tubes or channels 220 for circulating a fluid, such as a coolant or refrigerant, as shown in FIG. 2. Tubes or channels 220 may be positioned within a jacket 210. Tubes or channels 220 may be arranged in a serpentine pattern in jacket 210 so as to maximize a length of tube or channel 220 in jacket 210 and maximize heat transfer. Further, tubes or channels 220 may be arranged in a single plane. Tubes or channels 220 may be partially exposed or may be fully enclosed or encapsulated by jacket 210. Jacket 210 may be composed of a material having a high thermal conductivity to facilitate heat transfer. In some embodiments, jacket 210 may be composed of metal, such as copper, aluminum, steel, or a combination thereof, among other suitable materials. Cold plate 200 may have a plate-like configuration, such that cold plate 200 is generally planar and may have a rectangular configuration with a length and/or width greatly exceeding a thickness of cold plate 200.

Cold plate 200 may further contain a phase-change material (PCM) 900. Jacket 210 may contain and store a PCM 900, such that the PCM 900 surrounds tubes 220 within jacket 210. A PCM is a material having a high latent heat of fusion, such that at a phase change temperature at which the material transitions from liquid to solid, or solid to liquid, the material absorbs heat at a constant or near constant temperature. Any of various PCMs may be used in cold plate 200, such as a eutectic solution. The PCM may be selected so as to have a desired melting point (e.g., phase change temperature) for maintaining a cooler at a particular temperature. In some embodiments, a melting point of a PCM may be below 32° F. One of ordinary skill in the art will appreciate that the particular PCM selected may depend upon the desired operating temperature or range of operating temperatures of the cooler, among other considerations.

When cold plate 200 is in use, PCM absorbs heat within cooler 100 so as to maintain cooler 100 at a desired temperature. However, the PCM must be periodically cooled or "charged" to remove the absorbed heat. In order to charge the PCM of cold plate 200, cold plate 200 may be placed in communication with a heat exchanger 230, as shown for example at FIG. 2. Fluid, e.g., a refrigerant, may be circulated through cold plate 200 to absorb heat from the PCM, in order to cool the PCM. Cold plate 200 may further include a pump 240 to facilitate circulation of the fluid. In some embodiments, cold plate 200 may further include a thermal switch 250 configured to automatically begin circulating fluid when a fluid temperature reaches a predetermined temperature maximum, such as 27° F. Upon reaching the predetermined temperature maximum, fluid is circulated from cold plate 200 to heat exchanger 230 in order to cool the fluid. When the temperature of the fluid reaches a predetermined operating temperature, such as for example 20° F., cold plate 200 may cease circulation of the fluid to heat exchanger 230 and the PCM is charged and is ready for use. In some embodiments, cold plate 200 may be placed in communication with a cooling unit 160 (see FIG. 3), such as a cooling unit 160 of a vehicle (e.g., a truck or semi-trailer) in which cooler 100 is positioned. Cooling unit 160 may include a condenser, compressor, and expansion valve, and cold plate 200 may serve as the evaporator of cooling unit 160. In some embodiments, cooling unit 160 may further include a fan 165 for circulating air within cooler 100 and over surface 205 of cold plate 200. Thus, cooling unit 160 may circulate refrigerant through tubes 220 of cold plate 200 to charge the PCM 900 of cold plate 200.

A defrosting system 300 is used to remove frost or ice from cold plate 200. In some embodiments, defrosting system 300 is configured to remove frost or ice from a surface 205 of cold plate 200, such as an interior facing surface of cold plate 200 within cooler 100. In some embodiments, defrosting system 300 may include a heating element 310 in communication with a control unit 350 for selectively activating and deactivating heating element 310, as shown for example in FIG. 3. In some embodiments, heating element 310 is arranged on surface 205 of cold plate 200. In some embodiments, a plurality of heating elements 310 are arranged on surface 205 of cold plate 200 (see FIG. 1). One of ordinary skill in the art can readily select a suitable number of heating elements 310 for melting ice or frost on surface 205 of cold plate 200 depending upon various factors including, for example, the size and power of heating elements 310 and the size of cold plate 200.

Heating elements 310 may be arranged in any of various positions on surface 205 of cold plate 200. Heating elements 310 may be arranged in one or more rows and/or columns on surface 205. In some embodiments, heating elements 310 may be arranged in a grid pattern. In some embodiments, heating elements 310 may be positioned on cold plate 200 at a location most susceptible to frost formation, such as a portion of cold plate 200 having a high density of tubes 220 or a portion of cold plate 200 at an inlet of tubes 220 into cold plate 200. The fluid returned to cold plate 200 from heat exchanger 230 may be at the lowest temperature because fluid absorbs heat as it circulates through cold plate 200 causing the temperature of the fluid to rise as it flows toward an outlet of cold plate 200. As a result, frost may be most likely to form at a portion of cold plate 200 at which tubes 220 and fluid therein first enter cold plate 200.

Figure 4:
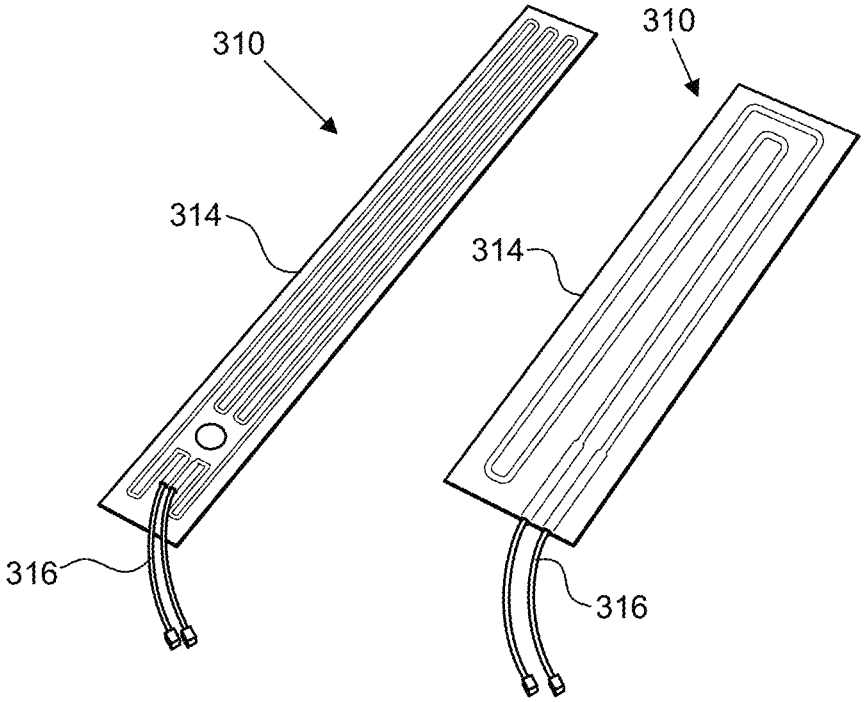
FIG. 4 shows foil heating elements according to an embodiment.
Figure 5:
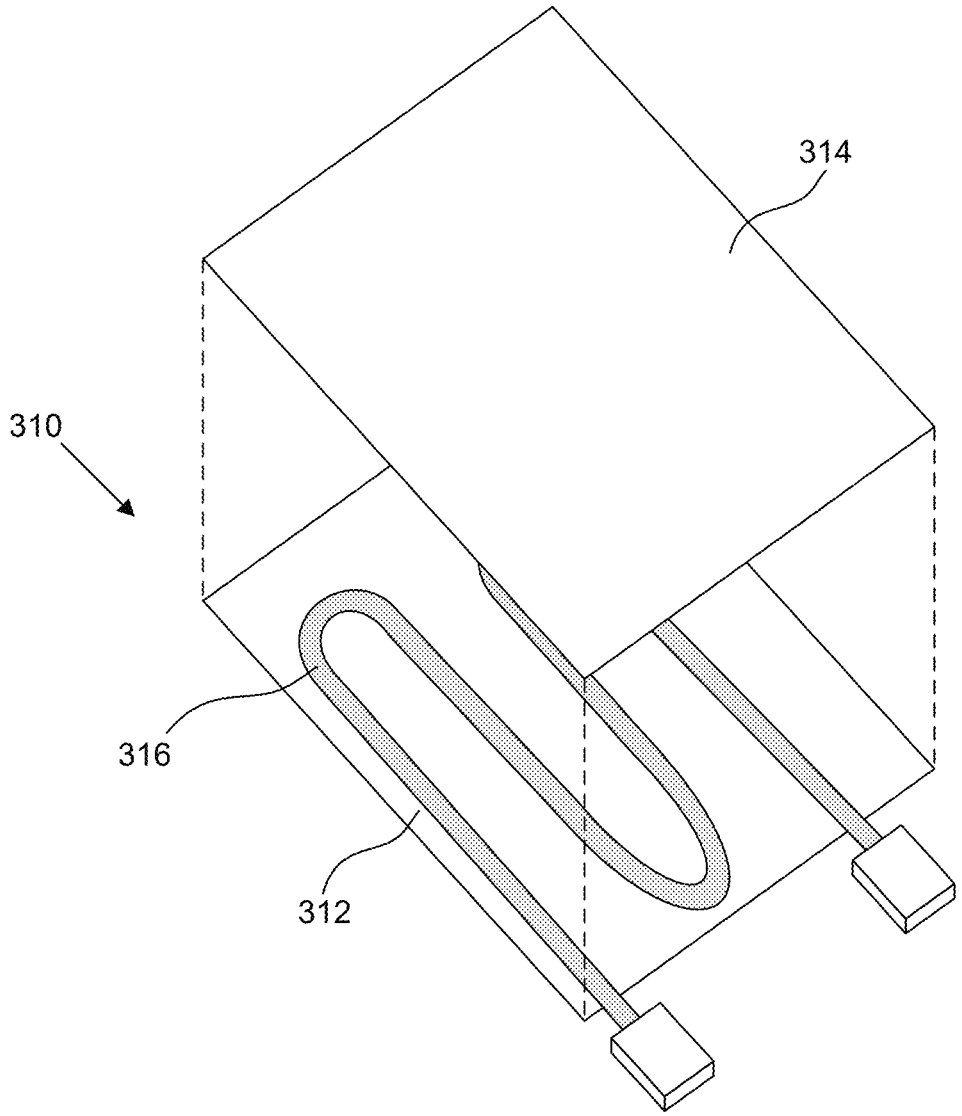
FIG. 5 shows an exploded view of a foil heating element according to an embodiment.

In some embodiments, heating element 310 is a foil heating element, as shown for example in FIGS. 4 and 5. A foil heating element 310 may include a heating wire 316, such as a nichrome wire, positioned on or between metal sheets 312, 314, such as aluminum sheets. However, in other embodiments, different types of heating wire 316 composed of different materials, and different types of metal sheets 312, 314 may be used. Heating wire 316 may be arranged in a single plane and may have a serpentine pattern so as to maximize the amount of heating wire 316 of foil heating element 310. Foil heating elements 310 may have a generally planar configuration, such that foil heating element 310 is an elongated, flat strip or plate. In this way, the flat profile of heating element 310 does not consume much space within cooler 100 and thus does not reduce the amount of storage space within cooler 100, and does not require adjustment or rearrangement of other components of cooler 100, such as shelves and the like. In some embodiments, heating element 310 may have a square or rectangular configuration with a length of about 12 cm to about 80 cm, a width of about 12 cm to about 80 cm, and a thickness of about 1 mm or less. However, in alternate embodiments, foil heating element 310 may have any of various alternate shapes, such as a circular disk-shape or a triangular shape, among others.

Each heating element 310 is configured to provide localized heat so as to at least partially melt frost or ice accumulated on surface 205 of cold plate 200 without heating, and raising the temperature of, the entire interior volume 110 of cooler 100. When heating element 310 is activated, temperature of the interior volume 110 of cooler 100 may increase by 5° F. degrees or less, 3° F. degrees or less, or 1° F. degree or less. Heating element 310 may be a low power heating element 310, and may be a 12V heating element. In this way, heating elements 310 are configured to melt frost on surface 205 of cold plate 200 without heating interior volume 110 of cooler 100 and perishable products therein. In some embodiments, heating element 310 is configured to only partially melt frost or ice on surface 205 rather than fully melting the frost or ice. In this way, the partially melted ice may slide along a surface of cold plate under the force of gravity clearing surface 205 of frost and ice while minimizing heating of interior volume 110 of cooler 100.

Heating elements 310 may be affixed to surface 205 cold plate 200 via any of various fastening methods. In some embodiments, heating elements 310 are affixed to cold plate 200 via an adhesive, such as a pressure-sensitive adhesive. Heating element 310 may include an adhesive on a surface thereof, or an adhesive may be applied to a surface of heating element 310, and heating element 310 may be attached to a surface 205 of cold plate 200 by placing surface of heating element 310 having the adhesive in facing engagement with surface 205 of cold plate 200. In this way, heating elements 310 can be easily and rapidly installed on any of various surfaces. The adhesive may be selected for use at low temperatures, such as at temperatures of about 0° F. to 40° F. Any of various types of adhesives may be used, such as a polymer-based adhesive, for example a polyester adhesive. In some embodiments, heating elements 310 may be integrally formed with cold plate 200.

In some embodiments, defrosting system 300 may further include a sensor 330 configured to detect a presence of frost on cold plate 200, such as frost on surface 205 of cold plate 200. Any of various types of sensors may be used to detect a presence of frost on a surface of cold plate 200. In some embodiments, sensor 330 is a temperature sensor for determining a temperature of fluid exiting cold plate 200 via tube 220, such as a thermistor or thermocouple among other suitable temperatures sensors. In order to measure a temperature of fluid exiting cold plate 200, temperature sensor 330 may be positioned on a portion of a tube 220 of cold plate 200, such as in or on a portion of tube 220 adjacent an exit of cold plate 200, as shown for example in FIG. 2. Control unit 350 of defrosting system 300 may be configured to activate heating element 310 when a temperature of a fluid exiting cold plate 200 as detected by temperature sensor is at or below a predetermined temperature minimum. As frost and ice accumulate on cold plate 200, transfer of heat to fluid within tubes 220 of cold plate 200 is inhibited, which may cause fluid within tubes 220 of cold plate 200 to remain at a low temperature as it passes through cold plate 200. Thus, a temperature of the fluid at or below the predetermined temperature minimum may indicate that heat is not being transferred to fluid due to an accumulation of frost on cold plate 200.

In some embodiments, sensor 330 may be a frost sensor for determining an amount of frost accumulated on a surface 205 of cold plate 200. In some embodiments, frost sensor may be an optical sensor. When frost sensor is an optical sensor, frost sensor may be configured to detect a change in reflectivity of light on surface 205 of cold plate due to scattering of light by accumulation of frost on surface 205. In some embodiments, frost sensor may be configured to detect a temperature of surface 205 of cold plate 200, as when cold plate 200 is free of frost cold plate 200 may be at a low temperature, such as 32° F., and when frost is present, temperature of surface 205 may be elevated, e.g., 34° F. In some embodiments, frost sensor may be a capacitive measuring device for detecting a change of measured signal when ice builds up between two points of the sensor. In this way, a frost sensor positioned on surface 205 of cold plate 200 may determine a thickness of the frost accumulated on surface 205 of cold plate 200 as measured in a direction perpendicular to surface 205. However, in alternate embodiments, other types of frost sensors for determining an amount of frost accumulated on a surface may be used. In some embodiments, upon a frost sensor detecting a presence of frost at or greater than a predetermined amount, such as for example at least about 2 mm of frost on surface 205, control unit 350 may activate heating element 310 to at least partially melt the frost.

In some embodiments, defrosting system 300 further includes a secondary sensor 380 configured to determine a temperature of a surface 205 of cold plate 200. Secondary sensor 380 may be, for example, an infrared sensor. If a temperature of surface 205 of cold plate 200 reaches a predetermined temperature maximum, heating element 310 is deactivated by control unit 350. Further, if temperature of a perishable product within the cooler 100 reaches an override temperature, greater that the temperature maximum, such as for example about 37° F. as determined by a secondary sensor 380, heating element 310 may automatically be deactivated by control unit 350. This prevents heating element 310 from becoming too hot and heating perishable products stored within cooler 100 which may cause spoilage or reduce the shelf-life or quality of the perishable products. In some embodiments, secondary sensor 380 is positioned within cooler 100 adjacent surface 205 of cold plate 200, such as on an interior wall of cooler 100 adjacent cold plate 200 such that secondary sensor 380 is positioned to measure a temperature of surface 205 of cold plate 200.

In some embodiments, defrosting system 300 may include any of various types of power sources, such as a battery, or may be configured to be connected to a power source to provide electrical energy to each of control unit 350, sensors 330, 380, and heating elements 310. In some embodiments, defrosting system 300 may be configured to be powered by a power source of a cooler 100 or a cooling unit 160 of cooler 100 in which defrosting system 300 is installed.

Figure 6:
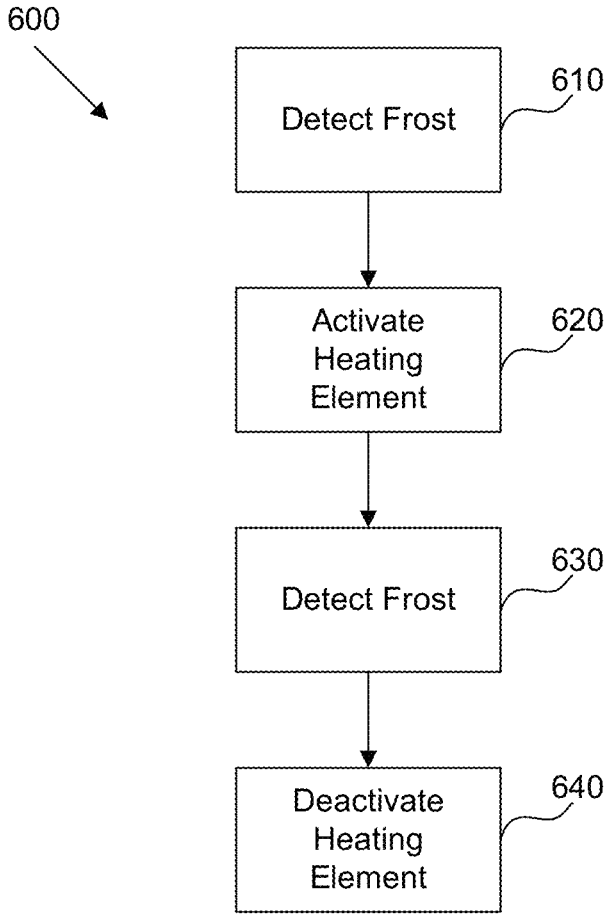
FIG. 6 shows a flow chart of a method for defrosting a cold plate according to an embodiment.

In some embodiments, a method for defrosting a cold plate 600 is shown for example at FIG. 6. Defrosting system detects a presence of frost or ice on a surface of cold plate 610. The presence of frost or ice on cold plate may be detected by a sensor as described herein. When a presence of frost or ice is detected by sensor, a control unit of defrosting system may activate heating element 620. Once heating element is activated, defrosting system may again detect the presence of frost 630 to determine if the frost has been melted or at least partially melted by heating element. Sensor may continually detect the presence of frost or may check periodically. Once sensor detects that frost is melted or at least partially melted (such as by an increased temperature of the fluid exiting cold plate as determined by a temperature sensor, or by a decreased amount of frost on surface of cold plate as detected by a frost sensor), defrosting system deactivates heating element 640. In some embodiments, heating element may be deactivated without the step of detecting frost 630. In such embodiments, heating element may instead be activated for a predetermined amount of time, e.g., for five minutes, ten minutes, fifteen minutes, or the like, and upon the expiration of the predetermined amount of time, heating element is automatically deactivated by a control unit of defrosting system. In other embodiments, upon activation of heating element 620, heating element may subsequently be deactivated automatically when a temperature of surface of cold plate as detected by a secondary sensor 380 is at or above a predetermined temperature maximum.

Figure 3:
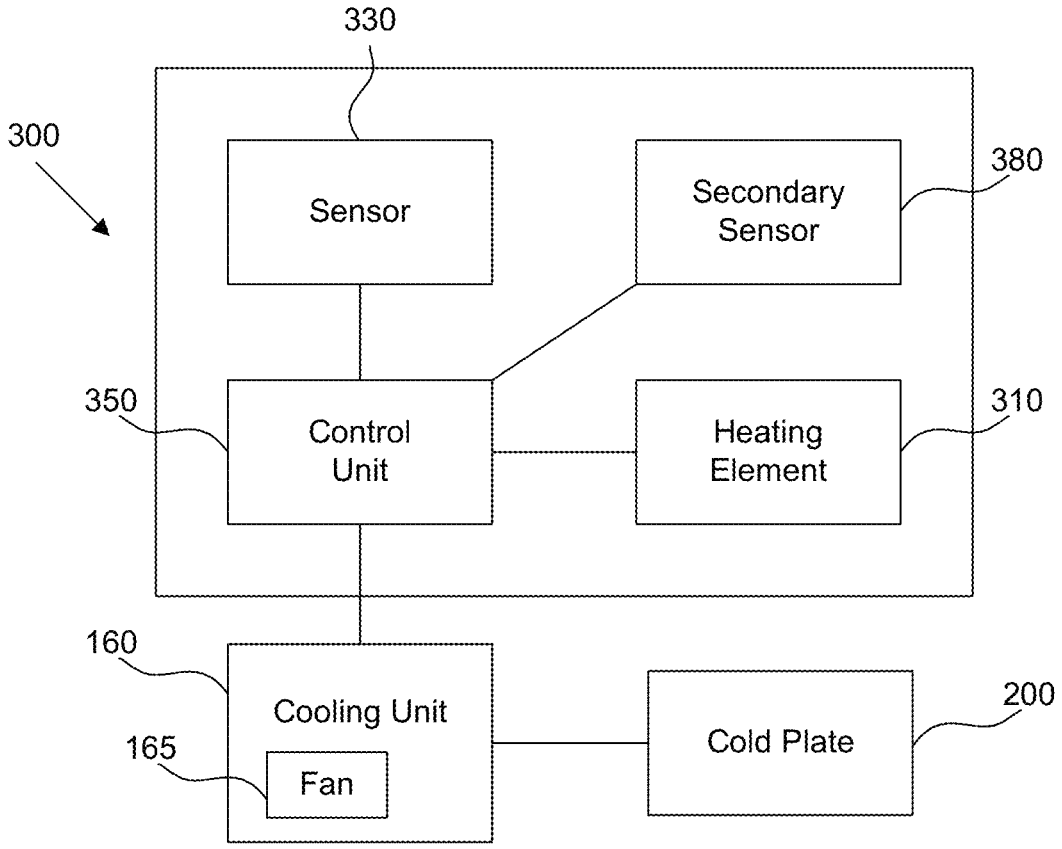
FIG. 3 shows a schematic diagram of components of a defrosting system according to an embodiment.
Figure 7:
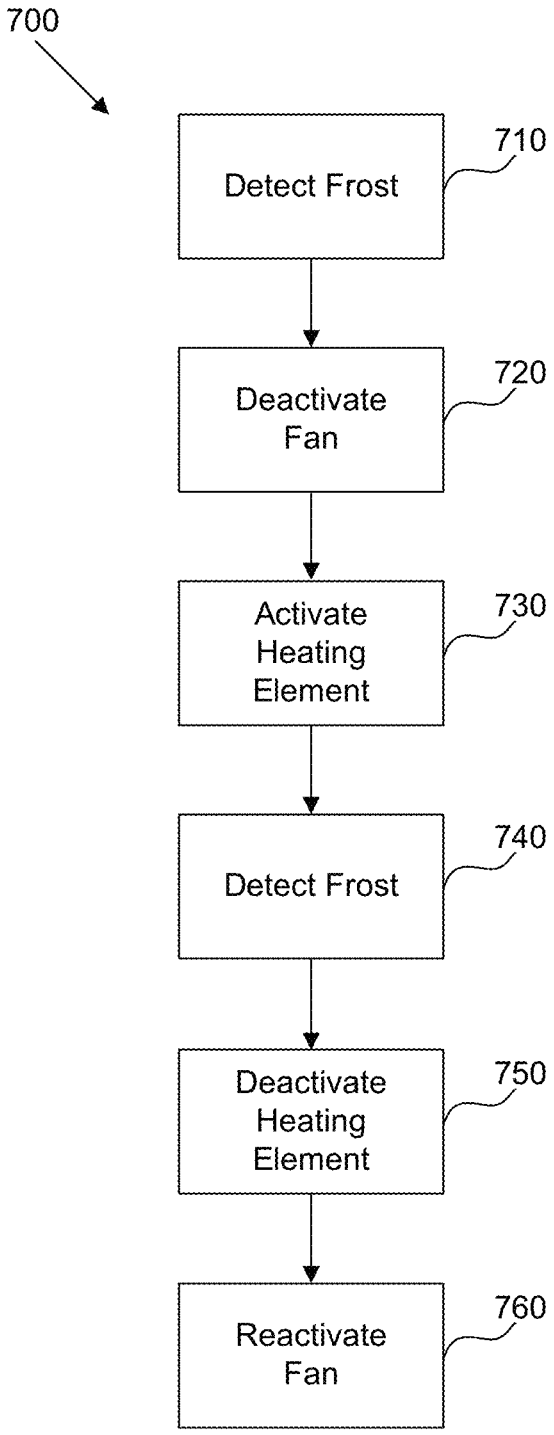
FIG. 7 shows a flow chart of a method for defrosting a cold plate according to an embodiment.

In some embodiments, defrosting system 300 is in communication with a cooling unit 160 of cooler 100, as shown in FIG. 3. In such embodiments, a method for defrosting a cold plate 700 may include detecting a presence of frost or ice on a surface of cold plate via one or more sensors 710, as shown in FIG. 7. Upon detection of the presence of frost or ice, defrosting system may be configured to deactivate the cold plate so as to stop circulating refrigerant through cold plate, and/or deactivate a fan 720 that circulates air over a surface of the cold plate. In this way, when heating element is subsequently activated, the fan does not circulate the heat supplied by heating element throughout interior volume of cooler, which may result in an increase of the temperature within cooler. Once the cold plate and/or fan are deactivated, control unit of defrosting system may activate heating element 730 so as to melt the frost or ice. With heating element activated, sensor may again detect a presence of frost 740. Once sensor detects that frost or ice is melted or partially melted, heating element is deactivated 750. As discussed above with respect to method 600, heating element may operate for a predetermined amount of time and automatically deactivate upon expiration of the predetermined amount of time, or may operate until a secondary sensor determines a temperature of a surface of cold plate is at or above a predetermined temperature maximum. Once heating element is deactivated, the cold plate and/or fan may be reactivated 760. In some embodiments, cold plate and/or fan may remain deactivated after deactivating the heating element for a predetermined dwell time, such as for one minute, two minutes, five minutes, ten minutes, or fifteen minutes, among other time periods, prior to reactivation. In this way, heating element may have time to cool to avoid circulating residual heat from heating element.

In some embodiments, the method of defrosting the cold plate may include activating cooling unit 160 and cold plate 200 to cool the interior volume of cooler 100 and the perishable products therein prior to activating heating element 310 to at least partially melt frost or ice on cold plate 200. Cooling unit 160 may operate until a temperature of cold plate 200 reaches a predetermined temperature, such as a temperature of about 22° F., or until a temperature of a perishable product as determined by secondary sensor 380 reaches a predetermined storage temperature, such as about 34° F. It is understood that the predetermined storage temperature may depend upon the particular perishable product being stored. Once the predetermined storage temperature is reached, cooling unit 160 may be deactivated so as to stop the flow of fluid, e.g., refrigerant, through cooling unit 160, and heating element 310 is activated in order to at least partially melt frost on cold plate 200. Activating cooling unit 160 to cool interior volume 110 of cooler 100 prior to activating heating element 310 helps to ensure that the perishable products are maintained within a desired range of storage temperatures and are not overheated upon activation of heating element 310.

Figure 8:
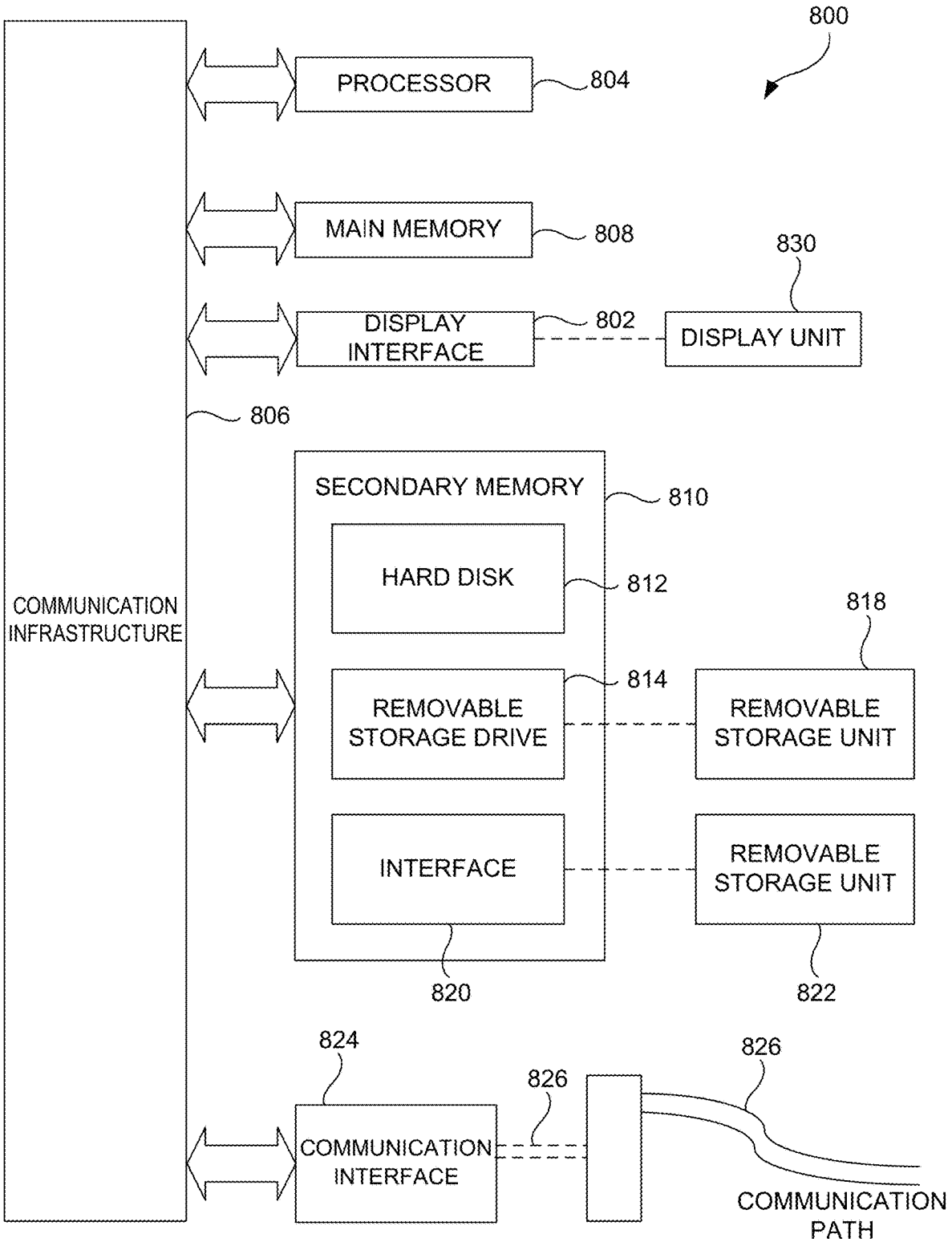
FIG. 8 shows a schematic block diagram of an exemplary computer system in which embodiments may be implemented.

FIG. 8 illustrates an exemplary computer system 800 in which embodiments, or portions thereof, may be implemented as computer-readable code. Control units 350 as discussed herein may be computer systems having all or some of the components of computer system 800 for implementing processes discussed herein.

If programmable logic is used, such logic may execute on a commercially available processing platform or a special purpose device. One of ordinary skill in the art may appreciate that embodiments of the disclosed subject matter can be practiced with various computer system configurations, including multi-core multiprocessor systems, minicomputers, and mainframe computers, computer linked or clustered with distributed functions, as well as pervasive or miniature computers that may be embedded into virtually any device.

For instance, at least one processor device and a memory may be used to implement the above described embodiments. A processor device may be a single processor, a plurality of processors, or combinations thereof. Processor devices may have one or more processor "cores."

Various embodiments of the invention(s) may be implemented in terms of this example computer system 800. After reading this description, it will become apparent to a person skilled in the relevant art how to implement one or more of the invention(s) using other computer systems and/or computer architectures. Although operations may be described as a sequential process, some of the operations may in fact be performed in parallel, concurrently, and/or in a distributed environment, and with program code stored locally or remotely for access by single or multi-processor machines. In addition, in some embodiments the order of operations may be rearranged without departing from the spirit of the disclosed subject matter.

Processor device 804 may be a special purpose or a general purpose processor device. As will be appreciated by persons skilled in the relevant art, processor device 804 may also be a single processor in a multi-core/multiprocessor system, such system operating alone, or in a cluster of computing devices operating in a cluster or server farm. Processor device 804 is connected to a communication infrastructure 806, for example, a bus, message queue, network, or multi-core message-passing scheme.

Computer system 800 also includes a main memory 808, for example, random access memory (RAM), and may also include a secondary memory 810. Secondary memory 810 may include, for example, a hard disk drive 812, or removable storage drive 814. Removable storage drive 814 may include a floppy disk drive, a magnetic tape drive, an optical disk drive, a flash memory, or the like. The removable storage drive 814 reads from and/or writes to a removable storage unit 818 in a well-known manner. Removable storage unit 818 may include a floppy disk, magnetic tape, optical disk, a universal serial bus (USB) drive, etc. which is read by and written to by removable storage drive 814. As will be appreciated by persons skilled in the relevant art, removable storage unit 818 includes a computer usable storage medium having stored therein computer software and/or data.

Computer system 800 (optionally) includes a display interface 802 (which can include input and output devices such as keyboards, mice, etc.) that forwards graphics, text, and other data from communication infrastructure 806 (or from a frame buffer not shown) for display on display unit 830.

In alternative implementations, secondary memory 810 may include other similar means for allowing computer programs or other instructions to be loaded into computer system 800. Such means may include, for example, a removable storage unit 822 and an interface 820. Examples of such means may include a program cartridge and cartridge interface (such as that found in video game devices), a removable memory chip (such as an EPROM, or PROM) and associated socket, and other removable storage units 822 and interfaces 820 which allow software and data to be transferred from the removable storage unit 822 to computer system 800.

Computer system 800 may also include a communication interface 824. Communication interface 824 allows software and data to be transferred between computer system 800 and external devices. Communication interface 824 may include a modem, a network interface (such as an Ethernet card), a communication port, a PCMCIA slot and card, or the like. Software and data transferred via communication interface 824 may be in the form of signals, which may be electronic, electromagnetic, optical, or other signals capable of being received by communication interface 824. These signals may be provided to communication interface 824 via a communication path 826. Communication path 826 carries signals and may be implemented using wire or cable, fiber optics, a phone line, a cellular phone link, an RF link or other communication channels.

In this document, the terms "computer program medium" and "computer usable medium" are used to generally refer to media such as removable storage unit 818, removable storage unit 822, and a hard disk installed in hard disk drive 812. Computer program medium and computer usable medium may also refer to memories, such as main memory 808 and secondary memory 810, which may be memory semiconductors (e.g. DRAMs, etc.).

Computer programs (also called computer control logic) are stored in main memory 808 and/or secondary memory 810. Computer programs may also be received via communication interface 824. Such computer programs, when executed, enable computer system 800 to implement the embodiments as discussed herein. In particular, the computer programs, when executed, enable processor device 804 to implement the processes of the embodiments discussed here. Accordingly, such computer programs represent controllers of the computer system 800. Where the embodiments are implemented using software, the software may be stored in a computer program product and loaded into computer system 800 using removable storage drive 814, interface 820, and hard disk drive 812, or communication interface 824.

Embodiments of the invention(s) also may be directed to computer program products comprising software stored on any computer useable medium. Such software, when executed in one or more data processing device, causes a data processing device(s) to operate as described herein. Embodiments of the invention(s) may employ any computer useable or readable medium. Examples of computer useable mediums include, but are not limited to, primary storage devices (e.g., any type of random access memory), secondary storage devices (e.g., hard drives, floppy disks, CD ROMS, ZIP disks, tapes, magnetic storage devices, and optical storage devices, MEMS, nanotechnological storage device, etc.).

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventors, and thus, are not intended to limit the present invention(s) and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, and without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

The breadth and scope of the present invention(s) should not be limited by any of the above-described exemplary embodiments, but should be defined only in accordance with the following claims and their equivalents.

What is claimed is:

1. A cooler, comprising:

a cabinet comprising a door and a plurality of interior walls defining a storage area for storing a perishable product, the door configured to move between an open position and a closed position;

a cold plate disposed on a first interior wall of the plurality of interior walls of the cabinet, wherein the cold plate comprises a jacket enclosing a phase-change material and a tube configured to circulate a refrigerant, wherein the cold plate is configured to absorb heat within the cabinet; and a defrosting system comprising:

a sensor configured to detect a presence of frost on a surface of the cold plate;

a heating element affixed to the surface of the cold plate configured to at least partially melt frost on the cold plate; and a control unit configured to selectively activate and deactivate the heating element when the presence of frost is detected by the sensor and configured to activate the heating element when the cold plate absorbs heat within the cabinet, wherein the sensor is arranged on the surface of the cold plate, and the surface is an interior facing surface of the first interior wall of the storage area, wherein the door comprises a transparent portion such that the cold plate and heating element are visible through the transparent portion when the door is in the closed position, wherein the heating element comprises a heating wire arranged in a serpentine pattern in a single plane.

2. The cooler of claim 1, wherein the heating element comprises a foil heating element.

3. The cooler of claim 1, wherein the heating element is affixed to the surface of the cold plate by means of an adhesive.

4. The cooler of claim 1, wherein the heating element is one of a plurality of heating elements arranged on the surface of the cold plate.

5. The cooler of claim 1, wherein the phase-change material comprises a eutectic solution.

6. The cooler of claim 1, wherein the control unit is configured to activate the heating element for a predetermined amount of time.

7. The cooler of claim 6, wherein the control unit is configured to activate the heating element for the predetermined amount of time at a predetermined interval.

8. The cooler of claim 1, wherein the sensor is a temperature sensor configured to detect a temperature of a surface of the cold plate.

9. The cooler of claim 8, wherein the temperature sensor is a thermistor or thermocouple.

10. A method for defrosting a cold plate of a cooler, the cooler comprising a door and a plurality of interior walls defining a storage area for storing a perishable product, wherein the cold plate is positioned along a first interior wall of the plurality of interior walls and is inwardly facing towards the storage area such that the cold plate is visible through a transparent portion of the door when the door is in a closed configuration, the method comprising:

determining a presence of frost on an interior facing surface of the cold plate of the cooler by a sensor, wherein the cold plate encloses a phase-change material and a tube configured to circulate a refrigerant; and activating a heating element disposed on the interior facing surface of the cold plate when the presence of frost is detected by the sensor, such that the heating element at least partially melts the frost, wherein the sensor is arranged on the interior facing surface of the cold plate, and wherein the heating element comprises a flat profile configured not to reduce a storage volume within the cooler, and wherein the heating element has a thickness less than about 1 mm.

11. The method of claim 10, wherein activating the heating element comprises activating a foil heating element.

12. The method of claim 10, further comprising deactivating the heating element when a temperature of the surface of the cold plate reaches a predetermined temperature maximum as determined by a secondary sensor.

13. The method of claim 10, wherein the cooler comprises a fan configured to circulate air over the cold plate, and further comprising:

deactivating the fan prior to activating the heating element.

14. The method of claim 13, further comprising:

reactivating the fan after deactivating the heating element.

15. The method of claim 14, further comprising reactivating the fan after a predetermined dwell time has elapsed after deactivating the heating element.

16. The method of claim 10, wherein the sensor is a temperature sensor, and wherein the heating element is activated when a temperature of a fluid within the cold plate as determined by the temperature sensor is at or below a predetermined temperature minimum.

17. The method of claim 10, wherein the sensor is a frost sensor configured to determine an amount of frost on the cold plate, and wherein the heating element is activated when the amount of frost on the cold plate as determined by the frost sensor is at or above a predetermined amount.

18. A method for defrosting a cold plate of a cooler, the cooler comprising a door and a plurality of interior walls defining a storage area for storing a perishable product, wherein the cold plate is positioned along a first interior wall of the plurality of interior walls and is inwardly facing towards the storage area such that the cold plate is visible through a transparent portion of the door when the door is in a closed configuration, the method comprising:

determining a presence of frost on an inwardly facing surface of the cold plate by means of a sensor, wherein the cold plate comprises a jacket enclosing a phase change material and a tube for circulating a refrigerant;

activating a heating element comprising a heating wire that is disposed on the inwardly facing surface of the cold plate for a predetermined amount of time in order to at least partially melt the frost when the presence of frost is detected by the sensor; and deactivating the heating element once the predetermined amount of time has elapsed, wherein the sensor is arranged on the inwardly facing surface of the cold plate, and wherein the heating element is disposed at a portion of the cold plate having a plurality of tubes circulating refrigerant or at an inlet of the tube into the cold plate, wherein the heating wire is arranged in a serpentine pattern in a single plane.

19. The method of claim 18, further comprising activating the heating element for the predetermined amount of time at a predetermined interval.

* * * * *